United States Patent [19]

Frischknecht et al.

[11] Patent Number: 4,577,672

[45] Date of Patent: Mar. 25, 1986

[54] DEVICE FOR MANUFACTURING METAL STRIP

[75] Inventors: Bruno Frischknecht, Gwatt; Rolf Würgler, Esslingen, both of Switzerland

[73] Assignee: Swiss Aluminium Ltd., Chippis, Switzerland

[21] Appl. No.: 540,778

[22] Filed: Oct. 11, 1983

[30] Foreign Application Priority Data

Oct. 18, 1982 [CH] Switzerland ..... 6068/82

[51] Int. Cl.[4] ..... B22D 11/06

[52] U.S. Cl. ..... 164/428; 164/438; 222/591

[58] Field of Search ..... 164/428, 434, 438, 439, 164/335; 222/591, 596; 261/DIG. 39; 425/190, 194

[56] References Cited

U.S. PATENT DOCUMENTS

| | | | |
|---|---|---|---|
| 382,319 | 5/1888 | Norton et al. | 164/428 |
| 2,128,941 | 9/1938 | Hudson | 222/591 |
| 3,300,821 | 8/1967 | Nichols et al. | 164/434 |
| 3,478,813 | 11/1969 | Cofer et al. | 164/434 |
| 4,153,101 | 5/1979 | Chateau | 164/428 |

FOREIGN PATENT DOCUMENTS

| | | | |
|---|---|---|---|
| 1124192 | 2/1962 | Fed. Rep. of Germany | 222/591 |

*Primary Examiner*—Nicholas P. Godici
*Attorney, Agent, or Firm*—Bachman & LaPointe

[57] ABSTRACT

A device for casting metal strip is such that molten metal is fed via a nozzle into a gap between two rolls of a roll type continuous casting unit. The nozzle (4) is mounted on a nozzle beam (6) which is in turn mounted on a slide (34), the latter (34) being moveable in direction (x) by means of a power drive (37). Provided on both sides of the slide (34) are handwheels (40) which permit movement of the slide also at an angle to direction (x). The nozzle beam (6) is moveably mounted on a supporting section (7) which is connected to the slide (34) via a frame (33), the height of which frame (33) being adjustable via a ratchet type facility (41) or the like with suitable gearing and linkage facilities.

18 Claims, 3 Drawing Figures

DEVICE FOR MANUFACTURING METAL STRIP

BACKGROUND OF THE INVENTION

The invention relates to a device for manufacturing metal strip, in particular aluminum strip, having a nozzle which introduces the molten metal into a gap between two rolls of a roll type continuous casting unit mounted on a supporting section.

Known roll type casting units feature two rolls which are positioned one above the other held in place by the machine frame. At the level of the gap between the rolls there is a nozzle usually secured to the frame of the machine, through which nozzle molten metal is conducted from a launder and trough into the gap between the rolls. These nozzles can be installed and removed together with the nozzle holder. Access to the nozzles, however, is difficult because of the frame of the casting unit. For example the nozzle must be installed and adjusted from behind. The accuracy of adjusting the nozzle with respect to the roll gap suffers as a result of this.

Furthermore the known arrangement of the nozzle gives rise to bending forces which create great problems, especially when there is non-uniform loading of the nozzle.

SUMMARY OF THE INVENTION

The object of the present invention is therefore to avoid these disadvantages and in particular to develop a nozzle unit which is independent of the rest of the roll casting unit and which permits accurate adjustment of the nozzle position with respect to the roll gap.

This object is achieved by way of the invention in that the nozzle is mounted on a nozzle beam which in turn rests on a slide and such that the slide is moveable in the direction of casting by means of a power drive.

The slide is preferably guided by means of a rail which rests on a supporting arm which in turn is attached to the supporting section of the roll casting unit. As a result of this the nozzle is again an integral part of the casting unit, which is actually desireable, but due to its arrangement on the slide remains an individually manipulable unit. It can be moved away from the casting unit by a hydraulically or mechanically powered means thus making it easily accessable for installation, dismantling or, for example, for adjustment.

The same power means provides for movement of the nozzle to the roll casting unit, however with the provision of a certain limit, which can be exceeded manually by means of handwheels or the like. Consequently it is possible to achieve very accurate adjustment of the position of the nozzle with respect to the roll gap. The transmission of the rotation of the handwheels to the movement of the slide takes place via conventional linkage and gearing units. Preferred is the provision of such handwheels with linkage and gearing facilities on both sides of the slide so that the slide can also be moved to a specific angle to the direction of casting.

Further, within the scope of the invention is the concept that the height of the nozzle beam can be adjusted together with the nozzle. To this end the nozzle beam is mounted on a support which is connected via a frame to the side, the height of the frame being adjustable for example by means of ratchets or the like with appropriate gearing and linkage units. Here too it is preferred to have such adjustment facilities on both sides of the frame so that the nozzle beam can be tilted at a specific angle to the direction of height adjustment.

BRIEF DESCRIPTION OF THE DRAWINGS

Further advantages, features and details of the invention are revealed in the following description of a preferred exemplified embodiment of the invention and with the help of the drawings viz.

DETAILED DESCRIPTION

The arrangement of the present invention enables accurate adjustment of the nozzle unit, and is such that this precise setting can be repeated as often as desired.

The nozzle beam itself is made up basically of an approximately rectangular box which is interrupted by an inlet opening to which the nozzle connects up. This way the molten metal passes from a transfer trough through the inlet channel to the nozzle and from there via a nozzle outlet to the gap between the rolls.

According to the invention the inlet channel features across its whole breadth turret shaped projections between which plates can be inserted, thus making it possible to adjust the casting width as desired. At the same time the turret-shaped projections have the effect of reducing the heat transfer between nozzle and beam over the whole length of the nozzle beam, which contributes to the stability of the nozzle and nozzle beam system.

The moveable mounting of the nozzle beam on the supporting section takes place via at least two means of mounting according to the present invention. Firstly rolls or rollers are provided at the sides at the lower face of the nozzle beam; these rollers engage under projections on the supporting section. Between the rollers is a strip of material with, at the back, an inclined face on which a screw bolt impinges. The said bolt is held in place by a flange on the supporting section. If the bolt is tightened, it pushes the rollers under the projections and at the same time clamps the strip of material to the nozzle beam.

Usefully, however, a third bearing support is provided. In this case the strip of material does not cover the whole of the lower face of the nozzle beam i.e. part of the nozzle beam is suspended over the supporting section. This free part is, however, supported by spring loaded bolts. This set of springs is preferably situated between two flanges of the I-beam-shaped supporting section, one end of the springs being braced against a fixed plate while the other end acts via a disc on the bolt and thus exerts pressure on the nozzle beam. Such a set of springs is provided at a plurality of places between supporting section and nozzle beam. This arrangement provides compensation of the forces acting on the unit so that no bending forces act on the nozzle beam.

Figure 1:
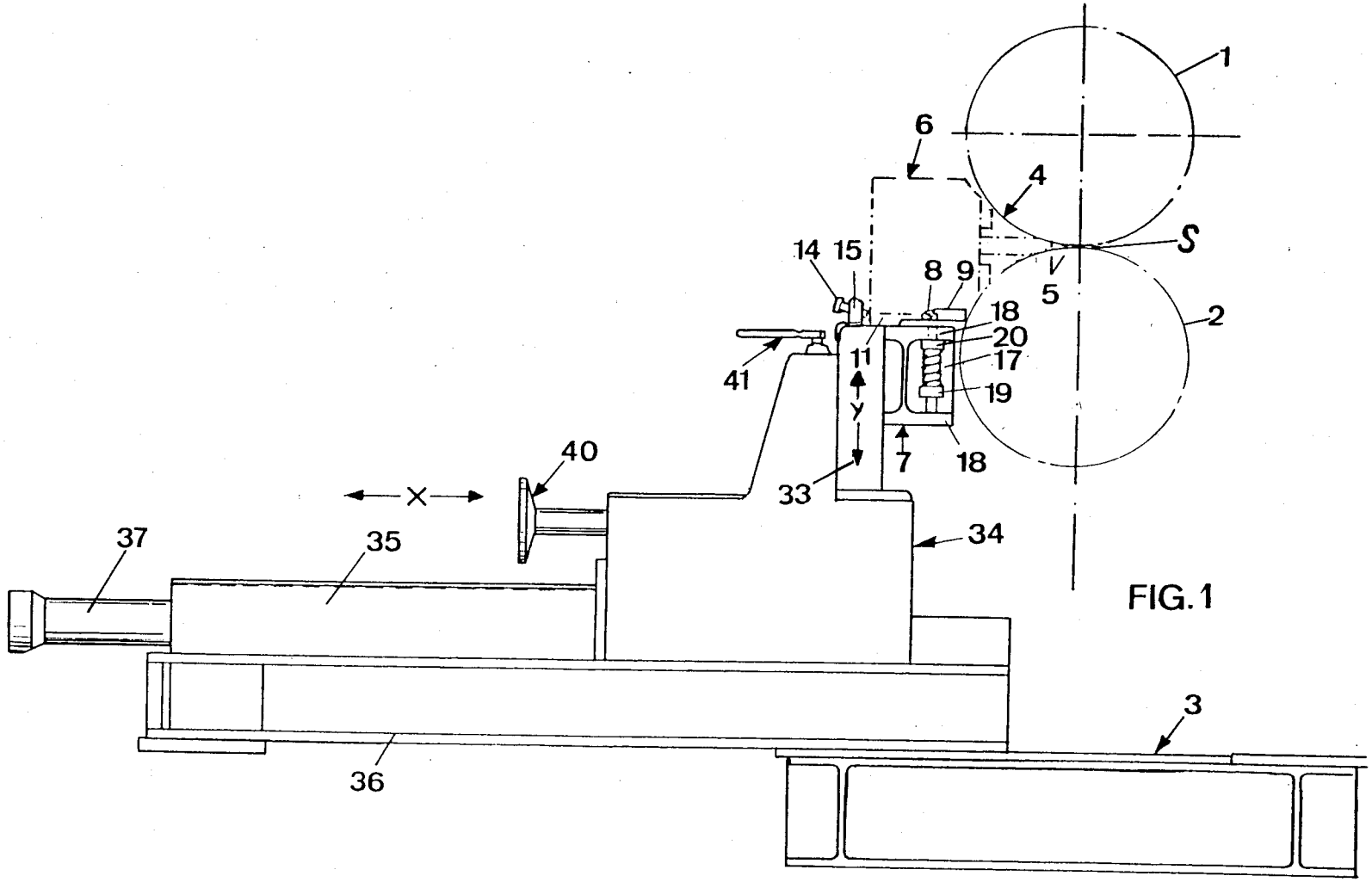
FIG. 1: Front elevation of a nozzle transport unit according to the invention.

Referring to the drawings, a nozzle 4 with lips 5 project into the gap S between two rolls 1 and 2, shown by broken lines in FIG. 1, of a roll type casting unit of which, for clarity, only a support section is shown. The nozzle 4 rests securely on a nozzle beam 6, in FIG. 1 both parts likewise being indicated only by broken lines.

The nozzle beam 6 rests on an I-beam 7 and is attached to the said I-beam in a number of ways. For example rollers 8 (FIG. 2) are provided at the sides on the under side 10 of the beam 6; these rollers 8 engage under appropriately shaped projections 9 on support 7. Provided on the lower side 10 of the nozzle beam 6 between the rollers 8 is a strip of material 11 which viewed in cross section features a desk-like surface 12 sloping towards the support 7; a screw bolt 14 meets the said surface 12 at an approximately right angle w (FIG. 3) after penetrating a securing means 15. In order to avoid bending forces, the nozzle beam 6 with strip of material 11 does not rest wholly on the beam 7, but can also be supported by a spring arrangement 17 so that no bending forces arise.

Figure 2:
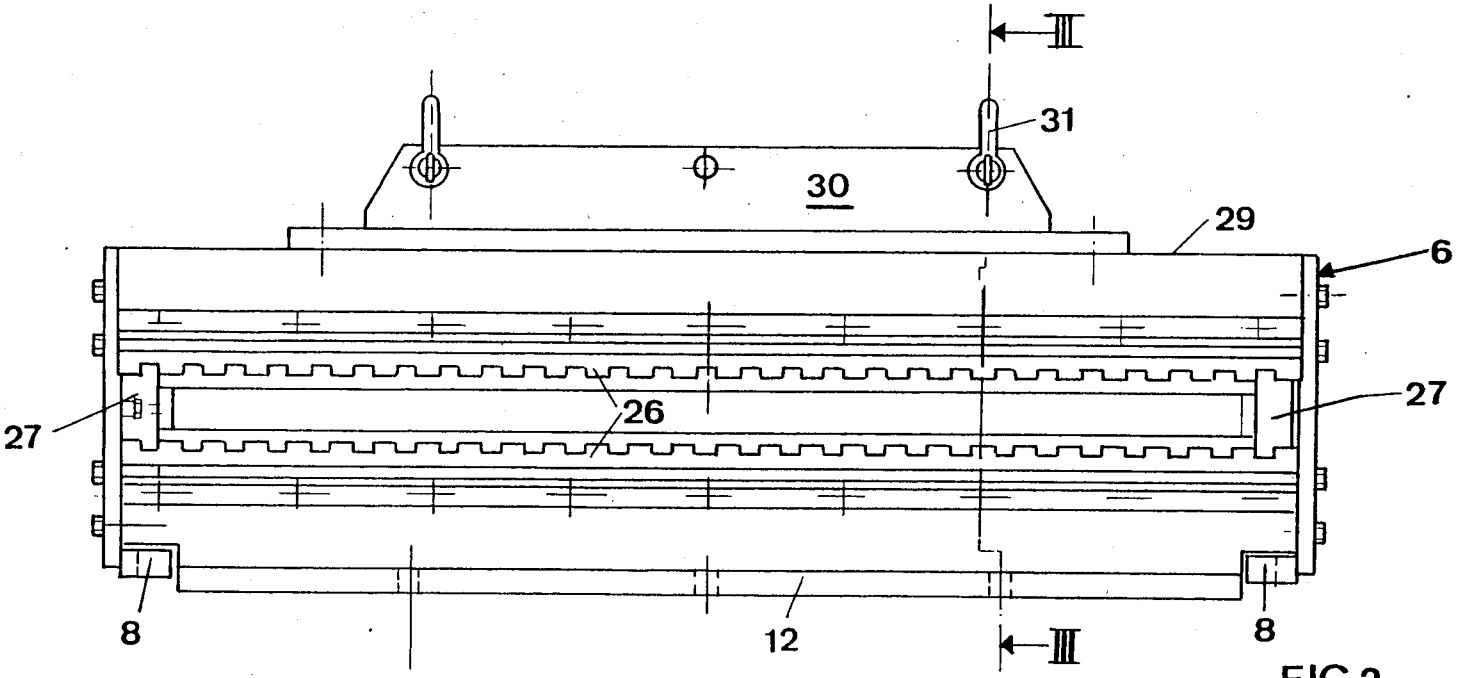
FIG. 2: An end view showing the back of an enlarged nozzle beam.
Figure 3:
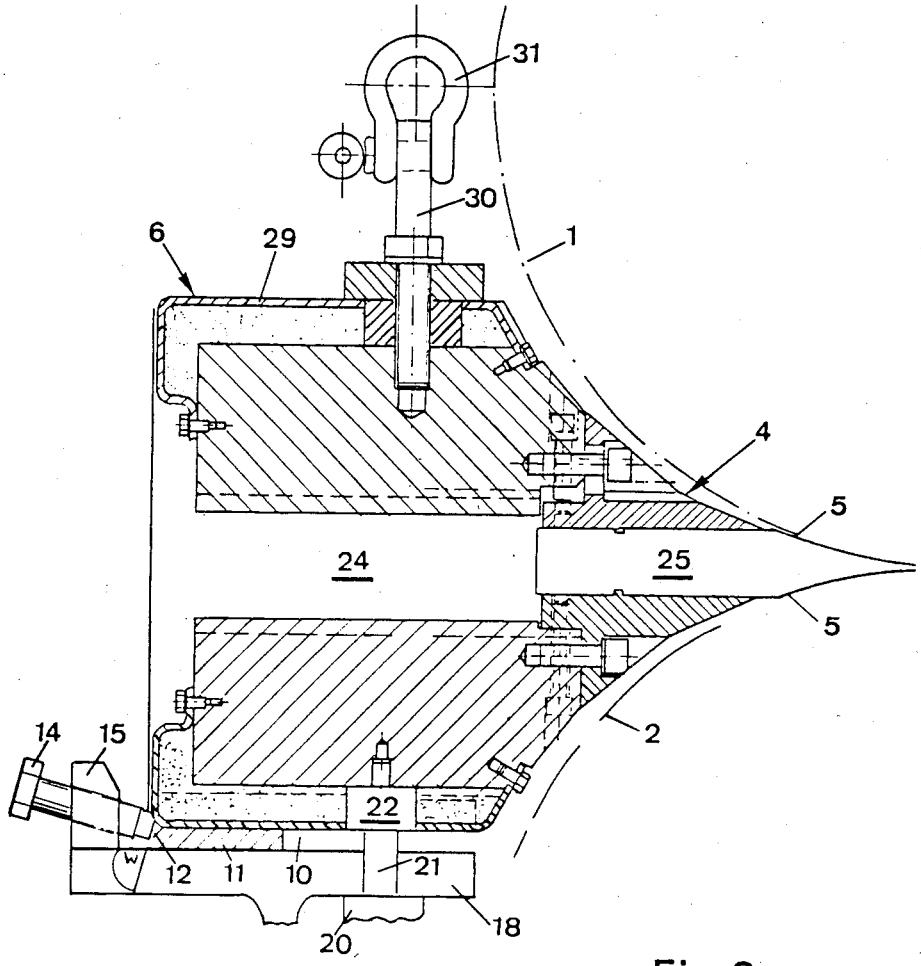
FIG. 3: An enlarged cross section through the nozzle beam with nozzle, divided along line III—III in FIG. 2.

Such a spring arrangement 17 is provided between both horizontal flanges 18 of the I-beam 7 and is braced against a fixed plate 19. At the other end the spring extension is limited by a disc 20 which can be moved against the force of the spring by means of a bolt 21 which is attached to a means of fixing 22 in the nozzle beam 6. As shown in FIG. 2 such a spring arrangement 17 is provided, for example, at three positions on the nozzle beam 6.

The molten metal passes from a casting launder, not shown here, to a trough and from there to inlet channel 24 in nozzle beam 6. Connecting up to this is the transfer channel 25 in nozzle 4 with outlet lips 5. The inlet channel 24 determines essentially the width of casting. Across its whole breadth it features facing turret-shaped projections 26 between which steel support plates 27 can be inserted and fixed between the turret-shaped projections to change the casting width.

The upper side 29 of the nozzle beam 6 is occupied by a strip 30 which features hooks 31 designed to accept a transportation product which is not shown here.

The whole unit comprising nozzle 4, nozzle beam 6 and support 7 is suspended on a frame 33 which can be adjusted in the direction y and part of which is a slide 34. This slide 34 is mounted on a rail 35 on which it can be moved in direction x by means of a hydraulic power unit 37. Rail 35 connects a support arm 36 to a support section 3 on the casting unit.

FIG. 1 shows only a sleeve of drive unit 37. A piston (not shown) connecting to slide 34 moves in said sleeve independent of drive unit 37.

The slide 34 is connected to a piston, not shown, which moves in a sleeve, the only part of the drive unit shown in FIG. 1. The slide 34 can also be moved in the direction x on rail 35 for fine adjustment of the nozzle position independent of the drive unit 37 via manual operation of handwheels 40 connecting to conventional linkage and gearing facilities which are not illustrated here, or at an angle to the direction x. Adjustment of height in direction y or at an angle to the direction y takes place via ratchet type facilities 41 which raise or lower the frame 33 via conventional linkage or gearing facilities, not shown here. Such handwheels 40 and ratchet type facilities 41 are provided on both sides of the slide 34 so that a different degree of adjustment is possible both in direction x and in direction y. This way the transfer channel 25 is moved with highest degree of accuracy to the level of the roll gap.

What is claimed is:

1. Device for horizontal casting of metal strip which comprises two substantially vertically disposed rolls of a roll type continuous casting unit one above the other having a roll gap therebetween, a supporting section mounting said rolls, a substantially horizontally disposed nozzle which introduces molten metal into said gap, a nozzle beam mounting said nozzle including an inlet channel which includes facing, turret-shaped projections which accommodate plates for limiting the casting width, a slide supporting said nozzle beam such that the slide is moveable in the substantially horizontal direction (x), a rail on which said slide moves and a power drive for moving said slide.

2. Device according to claim 1 for manufacturing aluminum strip.

3. Device according to claim 1 including a support arm attached to the supporting section, wherein said rail rests on said support arm.

4. Device according to claim 1 wherein the power drive is hydraulic.

5. Device according to claim 1 wherein the power drive is mechanical.

6. Device according to claim 1 including means operatively associated with the slide which enable movement of the slide at an angle to the direction (x).

7. Device according to claim 6 wherein said means are handwheels located on both sides of the slide which permit movement of the slide at an angle to the direction (x).

8. Device according to claim 1 including means for adjusting the height of the nozzle beam.

9. Device according to claim 8 wherein said means for adjusting the height is operative for adjusting the height of the nozzle beam in the substantially vertical direction (y) together with the nozzle.

10. Device according to claim 9 wherein the nozzle beam is moveably mounted on a support beam.

11. Device according to claim 10 wherein said support beam is connected via a frame to the slide.

12. Device according to claim 11 wherein the height of the frame is adjustable via a ratchet type facility.

13. Device according to claim 11 wherein the frame can be adjusted at an angle to direction (y) via ratchet type facilities.

14. Device according to claim 5 including an inclined surface provided on a strip of material between said nozzle beam rollers, and a screw bolt held in a flange of the support beam meets said inclined surface at an approximately right angle (w).

15. Device according to claim 14 wherein the strip of material only partly connects the lower surface of the nozzle beam with the support beam and the part of the said lower surface not in contact with the strip of material is supported on springs.

16. Device according to claim 15 wherein said support beam is an I-beam-shaped support having flanges, wherein a spring arrangement is provided between the flanges of the I-beam-shaped support.

17. Device according to claim 16 including a fixed plate bracing said spring at one end while at the other end the said lower surface of the nozzle beam accommodates the force of the spring via a bolt on a disc.

18. Device for horizontal casting of metal strip which comprises two rolls on a roll type continuous casting unit having a roll gap therebetween, a supporting section mounting said rolls, a nozzle which introduces molten metal into said gap, a nozzle beam mounting said nozzle, means for adjusting the height of the nozzle beam operative for adjusting the height of the nozzle beam in direction (y) together with the nozzle, a support beam moveably mounting said nozzle beam including projections thereon, rollers at the bottom of the nozzle beam engaging under said projections, a slide supporting said nozzle beam such that the slide is moveable in the direction (x) and a power drive for moving said slide.

* * * * *